US006860207B1

(12) United States Patent
Robertson

(10) Patent No.: US 6,860,207 B1
(45) Date of Patent: Mar. 1, 2005

(54) COMPRESSIBLE SHOT SHELL

(76) Inventor: Thomas W. Robertson, 113 Longwood Dr., Mandeville, LA (US) 70471

( * ) Notice: Subject to any disclaimer, the term of this patent is extended or adjusted under 35 U.S.C. 154(b) by 0 days.

(21) Appl. No.: 10/646,592

(22) Filed: Aug. 22, 2003

(51) Int. Cl.[7] ..... F42B 7/08; F42B 7/04

(52) U.S. Cl. ..... 102/450; 102/448; 102/430; 102/444; 102/449; 102/532; 86/44; 42/70.11

(58) Field of Search ..... 102/448, 450, 102/430, 444, 446, 449, 439, 447, 451, 461, 532; 86/44; 42/70.11

(56) References Cited

U.S. PATENT DOCUMENTS

| | | | | | |
|---|---|---|---|---|---|
| 3,865,038 | A | | 2/1975 | Barr | |
| 5,171,934 | A | | 12/1992 | Moore | |
| 5,284,274 | A | * | 2/1994 | Lee et al. | |
| 5,341,744 | A | | 8/1994 | Shi | |
| 5,565,649 | A | * | 10/1996 | Tougeron et al. | 102/432 |
| 5,677,505 | A | | 10/1997 | Dittrich | |
| 5,700,972 | A | * | 12/1997 | Saxby | 102/444 |
| 6,250,228 | B1 | | 6/2001 | King | |
| 6,427,600 | B2 | | 8/2002 | Saxby | |

FOREIGN PATENT DOCUMENTS

| | | |
|---|---|---|
| DE | 96460 | 6/1897 |
| WO | WO 95/05573 | 2/1995 |

* cited by examiner

*Primary Examiner*—Michael J. Carone
*Assistant Examiner*—L. Semunegus
(74) *Attorney, Agent, or Firm*—Joseph T. Regard, Ltd, PLC

(57) ABSTRACT

A shot shell such as would be utilized in a shotgun or the like, wherein the cartridge forming the shell has a collapsible extension removably or permanently engaging the shot end of the cartridge, with the cartridge configured to provide a un-compressed length of, for example, 2.50 inches (the minimum length of shell for conventional automatic or semi-automatic, magazine fed shotguns. The collapsible extension is configured to be compressed when placed in a spring-fed magazine, so as to provide increased magazine capacity when compared to standard length shells, while expanding when removed by from the magazine during a loading cycle, so as to facilitate reliable placement of the shell into the breach from the magazine. The collapsible extension in the loaded cartridge of the present invention is configured to be ejected from the barrel upon firing of the cartridge. The present system thereby provides a means to increase the capacity of conventional automatic or semi-automatic (i.e., pump actuated) shotguns, while reducing the likelihood of jamming or malfunction due to utilizing shells which are shorter than the firearm was designed to process.

26 Claims, 7 Drawing Sheets

COMPRESSIBLE SHOT SHELL

TECHNICAL FIELD OF THE INVENTION

The present invention relates to shot shells such as would be utilized in a shotgun or the like, wherein the cartridge forming the shell has a collapsible extension removably engaging the shot end of the cartridge, the cartridge configured to provide a uncompressed length of, for example, 2.50 inches (the minimum length of shell for conventional automatic or semi-automatic, magazine fed shotguns. The collapsible extension is configured to be compressed when placed in a spring-fed magazine, so as to provide increased magazine capacity when compared to standard length shells, while expanding when removed by from the magazine during a loading cycle, so as to facilitate reliable placement of the shell into the breach from the magazine.

The collapsible extension in the loaded cartridge of the present invention is configured to be ejected from the barrel upon firing of the cartridge. The present system thereby provides a means to increase the capacity of conventional automatic or semi-automatic (i.e., pump actuated) shotguns, while reducing the likelihood of jamming or malfunction due to utilizing shells which are shorter than the firearm was designed to process.

BACKGROUND OF THE INVENTION

Standard shotgun shells for the 12 Gauge Shotgun vary in length from 2.5 inches to 3.00 inches, which can generally be fired from a standard semi-automatic pump or automatic shotgun.

3.25 to 3.75 inch magnum shells are also available for special guns designed to handle such size shells.

A limitation of standard shotguns relates to the amount of shells the magazine can hold, with the ordinary pump holding 4–5 shells maximum, as the magazine tube where the shells are stored is only typically about 14–16 inches long. There are magazine extenders available, but these only allow for an additional two or so shells, awkward to use because of the increased length of the magazine, can extend beyond the barrel, and can make the firearm unreliable.

The original length of the 12 gauge shell was believed to have been developed over 100 years ago, and was necessary because of the amount of powder required for the load. However, advances in black powder has resulted in substantially more power utilizing less powder. Consequently, as shown in FIG. 1, todays typical shell has a wad having a substantial cushion (8) which acts as a spacer between the lesser amount of powder (4) and the shot (2).

Because of advances in propellants including "smokeless powder" and the like, it is now possible to provide a "mini" shotgun shell (FIG. 2) having a length of, for example, 1.75 inches. Such a shell is already sold by the Aquila company of Mexico.

A problem with these "short" shells is that they cannot be used with a conventional automatic or pump action shotgun, because of their length. While they can be loaded into the magazine, allowing perhaps as much as twice the capacity of shells when compared to the longer shells, when the shells are moved one at a time by the firearm from the magazine to the firing chamber, the shorter shells jam because they tend to roll in the "litter" that is, the loading area between the magazine and the firing chamber.

One solution would be to design a firearm which would shoot these types of shells. However, a better solution would be to design a shell which stores like a "short" shell in the magazine, but loads like a conventional shell when moved from the magazine to the firing chamber, which shell could be used in conventional, off the shelf automatic and pump shotguns.

U.S. Pat. No. 5,171,934 issued 1992 teaches a "shortened shot shell having a reduced length that allows one or more extra rounds to be carried in the magazine of the standard shotgun" and teaches a longer wadding "that avoids tilting or tumbling of the wadding" in the barrel after firing, but does not teach the extension end of the present invention.

U.S. Pat. No. 6,427,600 teaches a "blank cartridge for self loading guns" wherein there is provided a "bullet-like projection being retractable. When the cartridge is fired" to facilitate recycling of the firearm. This is relevant in that the structure of the cartridge anticipates a telescoping front end, albeit for a different purpose than that taught in the present, searched for invention. PCT/B94/01779 is the PCT case on the above '600 patent.

U.S. Pat. No. 5,341,744 is referenced as it contemplates a plastic foam extension (26) emanating from the front end of the cartridge. See also U.S. Pat. No. 3,865,038.

U.S. Pat. No. 5,677,505 teaches a "reduced energy cartridge" having a recoiling inner piston, although for a different purpose than that contemplated in the present invention.

German patent 96460 teaches some interesting structure of a shot shell cartridge, but have had difficulty in translating.

U.S. Pat. No. 6,250,228 teaches a "compression shotgun cartridge" having a "compressible compression cup", but does not appear to teach the concept of the present invention.

GENERAL SUMMARY DISCUSSION OF THE INVENTION

The present invention provides a cartridge which is partially collapsible along its length, so as to facilitate increased shot shell capacity in the magazine in a firearm, while allowing cycling of a shortened shell in a conventional automatic or semi-automatic firearm.

The shell of the preferred embodiment of the present invention comprises a cartridge having a length having a breach end and a shot end, the cartridge being shorter in length than conventional shotgun cartridges, for example, 2.25 inches.

A principle improvement of the system relates to a collapsible extension removably engaging the shot end of the cartridge to provide an uncollapsed length of, for example 2.50 inches (the minimum length of shell for conventional automatic or semi-automatic, magazine fed shotguns), the collapsible extension compressing when placed in a spring-fed magazine to provide maximum magazine capacity, while expanding during loading to facilitate reliable placement of the shell into the breach from the magazine.

The collapsible extension is configured to be ejected from the barrel with the firing of the cartridge. The present system thereby provides a means to increase the capacity of conventional automatic or semi-automatic (i.e., pump actuated) shotguns.

Shortened shot shells for shotguns are sold on the market, Aquila being one known manufacturer, but such shells cannot be fed via conventional magazine in automatic or semi-automatic shotguns due to their length, which is considerably less than the minimum 2¾ length of most such guns.

Further, many manufacturers now make guns which require a minimum shell length of 3", with 12 gauge shells having lengths as long as 3¾". The increase in popularity of these longer shell lengths may be the result in the mandated utilization of shell shot in waterfowl hunting, which has a lesser mass than lead, and is thereby less effective than lead shells of the same size.

The shortened shells provide more rounds with lesser weight, and would be beneficial for utilization in a conventional magazine, but for the design limitations imposed in getting the shell from the magazine, through the litter, into the breach.

The system of the present invention would be of great use to security forces and the military, as the shorter shell could be configured to provide sufficient firepower for the application, while providing increased magazine capacity. Also, the present shell could be versatile in the type of load it carries, and would be compatible with almost all loads, including buckshot, b—b, sabot, slug, etc.

The present invention therefore provides a shell which has a length about the same as a conventional shell, except that it compresses in the magazine to a size perhaps ¼to ½the original size, so as to allow greater magazine capacity, but when the shell is removed from the magazine by the loading mechanism of the firearm, it expands to full length for proper loading.

It is therefore an object of the present invention to provide a cartridge which is compressible along its length.

It is another object of the present invention to provide a shot shell cartridge having a collapsible material emanating from the shot end which allows compact storage in a conventional magazine, but effectively lengthens to the minimum length shell size for proper placement from the magazine to the breach.

It is another object of the present invention to provide a shortened shot shell which increase the capacity of conventional firearms, while facilitating reliable cycling of same, with no modification to the firearm.

Lastly, it is an object of the present invention to provide a shortened shot shell having a collapsible extension which increases in length when in an un-compressed condition, to a length sufficient for cycling from the magazine to the firing chamber by a conventional firearm.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 5 is an isometric view of a third embodiment of the present invention, illustrating a short shot shell having emanating therefrom a compressible spiraled member formed from polymer or the like.

FIG. 7 is a side, partially cut-away, partially cross-sectional view of a fourth alternative embodiment of the invention, illustrating a short shot shell having emanating therefrom a compressible accordion-configured member of polymer formed from polymer or the like.

DETAILED DISCUSSION OF THE INVENTION

Figure 1:
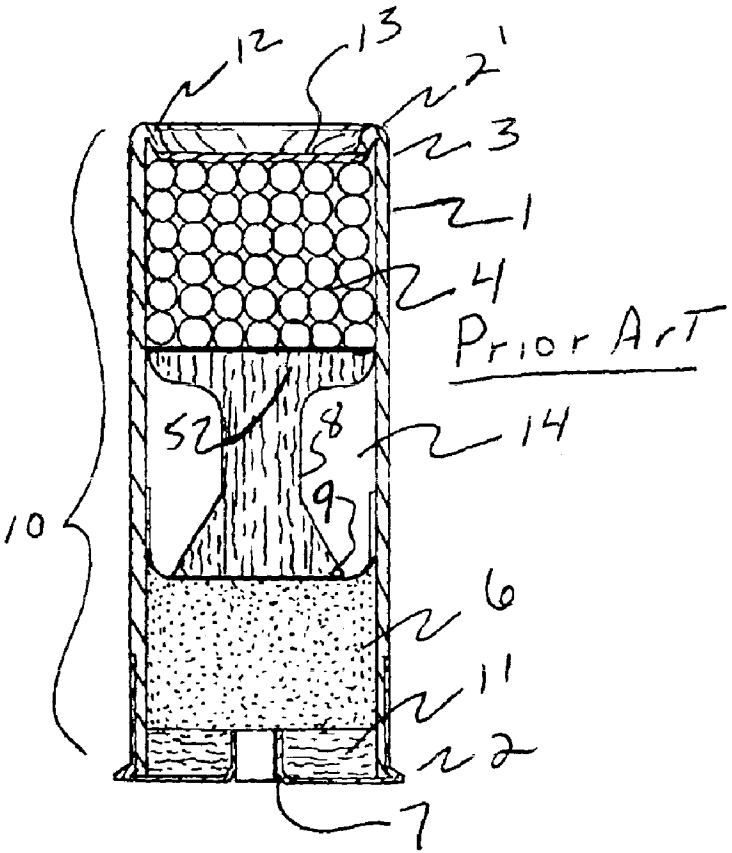
FIG. 1 is a side, cut-away view of a conventional prior art shot shell.

FIG. 1 illustrates a conventional prior art shotgun shell or shot shell 1 having an overall length 10 of about 2.5 inches, comprising a tube 3 forming an enclosure 14 having first 2, and second 2' ends, the first end containing a primer 7 surrounded by a base wad 11, which primer is configured to ignite propellant or powder 6, which urges shot 4, supported and cushioned by wad 5 from shell, upon firing from a firearm. Wad configurations vary depending upon application, but in a conventional shell as shown, a cushion 8 having a head 9 engaging the powder is provided, not only to cushion the shot, but also to function to fill space.

A shot cover 13 is provided to seal the shot in the tube at its load or shot end, which cover is held in place via a crimp 12 in the case of a separate cover, or alternatively forming a cover utilizing the tube by crimping the ends of the tube inward to seal same.

When the shell is fired, the separate shot cover is fired from the firearm with the shot, while in the alternative method of crimping the ends of the tube, said ends become un-crimped and return to a tube configuration to allow the shot to pass therethrough.

The cushion 8 may be utilized in modern conventional shells because less powder 6 or propellant is necessary, when compared to the black powder used when the shot shell was first developed.

Figure 2:
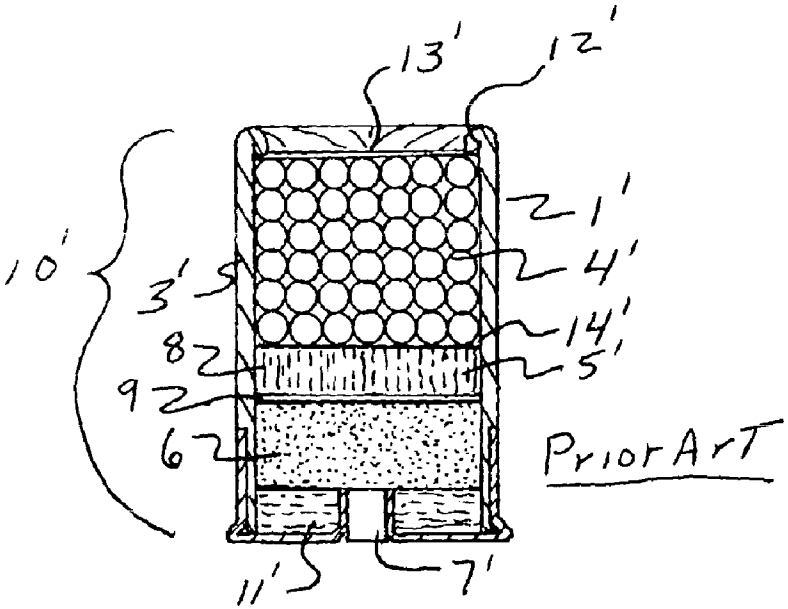
FIG. 2 is a side, cut-away view of a prior art short shot shell.

A typical prior art short shot shell 1', such as the 12 Gauge short shell manufactured by AQUILA of Mexico is shown in FIG. 2. It contains most if not all of the components of a traditional length shell in a tube only 1.5 inches in length.

As shown, the short shot shell forms an enclosure 14' having a base having a primer 7' surrounded by a base wad 11', configured to ignite the propellant or powder 6', which urges wad 5' (which may include cushion 8' and head 9') to push shot 4' from the shell and out of the barrel of the firearm. Shot cover 13' keeps the shot in, which may be secured via tube crimp 12', adhesive, hot melt, or other means well known in the art.

The improvement of the present invention comprises a compressible member provided at the shot end of the short shot shell, providing a compressible shot shell which compresses when in the magazine to provide increased magazine capacity in conventional arms, but uncompresses when removed from the magazine to simulate traditional length shells for autofeeding and like manipulation in automatic or semi-automatic arms.

While the present system is taught particularly for use with shotguns or the like, it is strongly iterated that this improvement may be utilized in a variety functionally similar applications.

In the present embodiment, the compressible shot shell may be accomplished with a an accordion-style portion of the wad or shell casing which emanates from the shell past the shot, which portion, if part of the wad, is shot from the shell upon use.

If part of the wad, the expansion component can be compressible by virtue of memory formed in the polymer in which it is made, or by other means, for example, a mechanical spring action integrated therein, or even a gas pocket or gas spring which is longitudinally compressible, but which expands when there is not pressure applied thereto.

Other possible compressible means could comprise a foam or polymer portion attached to the conventional short (Aquila) shell via adhesive or other releasable attachment, to convert the off-the-shelf shell into a shell useable with conventional automatic and semi-automatic firearms.

Figure 3:
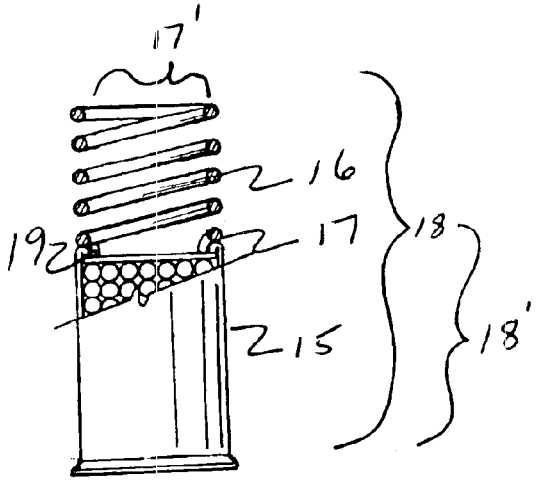
FIG. 3, is a side, partially cut-away, partially cross-sectional view of the preferred embodiment of the present invention, illustrating a short shot shell having mounted at its load end a compressible spring.

In FIG. 3, the first embodiment 15 of the present invention illustrates a helical spring 16 having an end 17 and an inner diameter 17' which first end 17 may be adhesively mounted or otherwise engaged 19 to the shot end of a shortened shell, or alternatively may be removably engaged by the open tube end being crimped over a portion of the first end 17 of spring 16. In such an embodiment, the spring would be ejected from the shell with the contents of the shell when it is fired.

In still another embodiment, the spring 16 may be permanently and integrally attached to the end of the tube and remain on the tube, so that the contents of the shell pass through its inner diameter 17' (in such embodiment the inner diameter 17' of the shell should be commensurate with the inner diameter of the tube forming the shell), therethrough when the shell is fired, thereby providing a shell having the conventional uncompressed length 18 of about 2.5 inches, and a compressed length 18' of about 1.75 inches. Increased magazine capacity is thereby provided, while providing the ability to manipulate the shell in conventional firearms.

Figure 4:
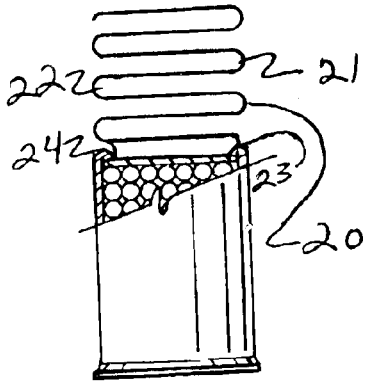
FIG. 4 is a partially cut-away, partially cross-sectional view of an alternative embodiment of the present invention, illustrating a short shot shell having mounted at its load end a compressible member.

FIG. 4 illustrates a second embodiment 20 of the present invention, wherein a compressible spring member 21 formed from a band of polymer or metal formed of a plurality of folds 22 having spring memory is mounted 24 on its first end 23 as the compressible member to the load end of the shot shell, via crimping, adhesive or the like. Alternatively, compressible member may be affixed to the wad.

Figure 5:
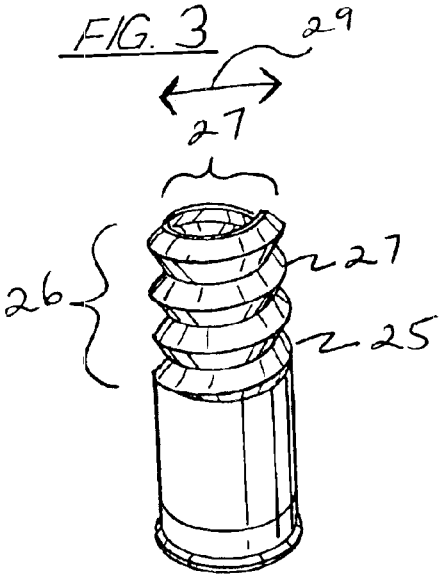
Figure 6:
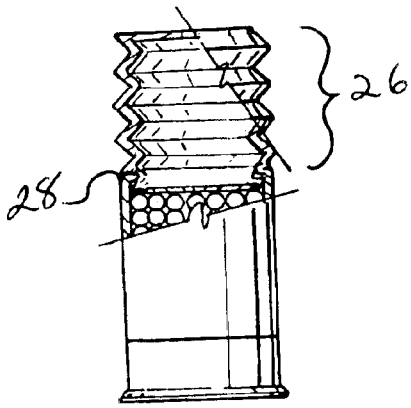
FIG. 6 is a side, partially cut-away view of the invention of FIG. 5.

FIGS. 5 and 6 illustrate a third embodiment 25 of the present invention, wherein the load or shot end of the tube is formed to provide a compressible portion 26 comprising a spring of accordion-like folds 27 along its length, shown in a spiral configuration having an inner diameter 27' generally commensurate with that of the enclosure of the shot tube, which could be facilitated by the folds 27 forming the tube being forced outward into a tube configuration by the pressure generated by the firing of the shell.

Alternatively, the compressible portion can be separate from the tube, and removably mounted 28 to same via tube crimp or adhesive, wherein it could be designed to be ejected upon firing of the shell, or remain engaged to the tube with the contents of said tube passing therethrough.

Figure 7:
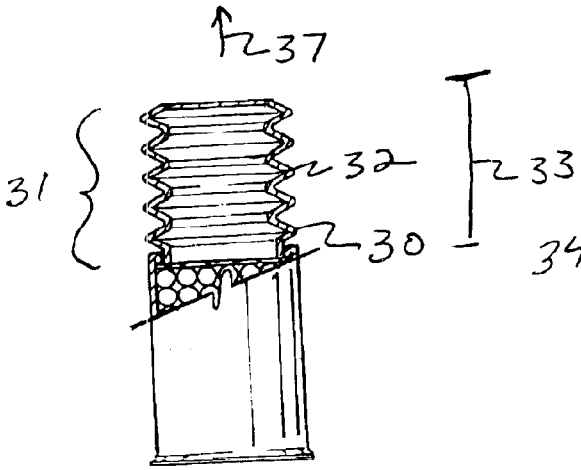
Figure 8:
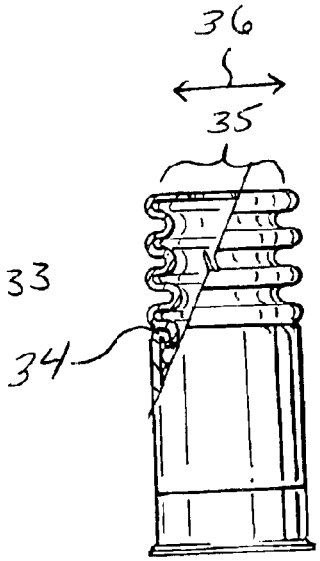
FIG. 8 is a side, partially cut-away, partially cross-sectional view of the invention of FIG. 7.

Like the embodiment of FIGS. 5 and 6, the fourth embodiment 30 of FIGS. 7 and 8 contemplate a compressible spring portion 31 in the form of a compressible tube of folded 32 material having a bias memory such as, for example, a bellows tube having a plurality of accordion-like folds 32 along its length 33 to form a spring, this embodiment not evidencing the spiral configuration of the third embodiment. Polymer or like material could be utilized to form this compressible member.

Like the third embodiment, however, the compressible tube of the fourth embodiment has an inner diameter 35 generally commensurate with that of the enclosure of the shot tube, which could be facilitated by the folds forming the tube being forced outward 36 into a tube configuration by the pressure generated by the firing of the shell.

Alternatively, the compressible portion can be separate from the tube, and removably mounted 34 to same via tube crimp or adhesive, wherein it could be designed to be ejected 37 upon firing of the shell, or alternatively remain engaged to the tube with the contents of said tube passing therethrough.

Figure 10:
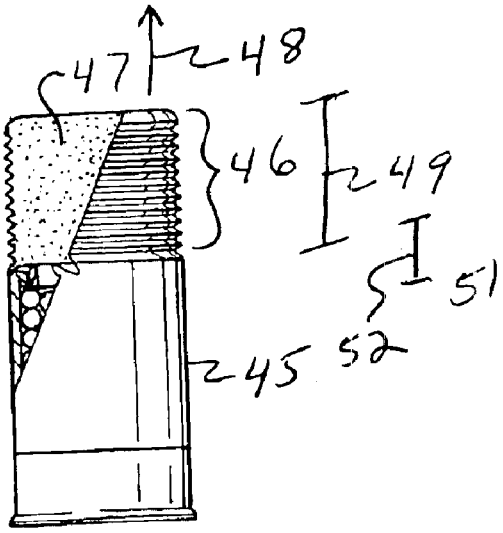
FIG. 10 is a side, partially cut-away view of the fifth embodiment of the present invention, illustrating a short shot shell having emanating therefrom a compressible foam encapsulated by a compressible polymer layer, in an uncompressed state.
Figure 11:
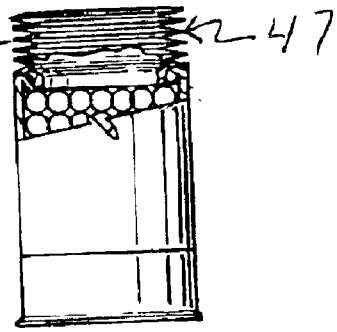
FIG. 11 is a side, partially cut-away view of the invention of FIG. 10, illustrating the compressible foam encapsulated by a compressible polymer layer, in a compressed state.

FIGS. 10 and 11 show a fifth embodiment 45 of the present invention which is a variant of the fourth embodiment, wherein there is provided a compressible tube portion 46 formed of memory resilient material, formed of a plurality of folds 51 along its length 49, which compressible tube portion may include a plug or foam core 47 of resilient compressible material which exhibits spring bias when compressed 52 such as polyurethane foam or the like, so as to form a foam spring. The foam core is ejected 48 from the tube when the shell is fired, along with the contents of the shell. Alternatively, instead of foam core 47, the compressible tube portion may be filled with air and removably capped to form a compressible air spring.

Ideally, the compressible tube portion is formed of the tube forming the shell and as such would remain with the shell after firing, or it could be configured to be ejected with the foam core upon firming, in which case it would be removably affixed to the load end of the shell via crimp, adhesive, releasable weld or the like.

Finally, a sixth embodiment 54 of the invention comprises a compressible foam extension 55 formed of compressible, memory biased material such as foam or the like to form another configuration foam spring, which extension is affixed or otherwise removably adhered 56 to the load end 58 of the shot shell, which compressible foam extension would be ejected from the shell when said shell is fired, along with the contents therein. Alternatively, it could be crimped to the shell and may form part of the shot cover. The compressible foam extension 54 would have an uncompressed length such that, when mounted to a short shot shell, the total length of the shell and extension 57 is commensurate with that of a conventional shell length, such as, for example, 2.5 inches.

In use, each of the above embodiments would be anticipated as being loaded and fired in the same manner, with the main distinction being that some embodiments would discharge the compressible extension or portion from the barrel upon firing of the shell, while in other embodiments, the compressible extension or portion would remain part of the shell and be discharged from the firearm with the spent shell. In addition, the compressible element may be utilized as a component for non-lethal use or other use, providing a dual use capability.

Figure 9:
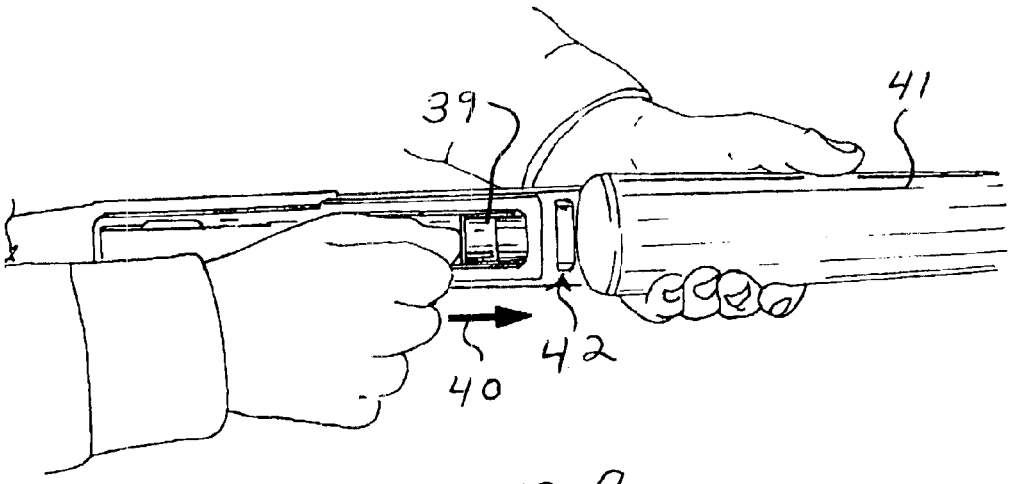
FIG. 9 is a side view illustrating a user loading the compressible shot shell of the present invention into the magazine of the firearm.

Referring to FIG. 9, the shot shell 39 of the present invention is inserted 40 into the magazine 42 of the firearm 41 as would be accomplished with a conventional shell. Continuing with FIGS. 13 and 14, this process is repeated until a plurality of compressed shot shells 59 are loaded into the magazine. As shown, the magazine 42 for a shotgun typically comprises a tube which receives shells at a first end, and applies spring bias to any shell loaded therein via a spring 69 or the like. This spring bias increases with the number of shells loaded, until the length of the tube forming the magazine has been filled.

This spring bias compresses the compressible member on the shot shell of the present invention, reducing its length 64 while subjected to the spring bias and other shells forming their own in the magazine, thereby allowing greater capacity. While a typical capacity for an off the shelf shotgun would be five 2.5 inch shells, it is estimated that utilizing the shot shell of the present invention would increase the capacity to at least six, and possibly 7 shells. With a tube extender, the magazine capacity could be further significantly increased.

In use, a shell from the magazine would be loaded as would normally be accomplished utilizing the firearm, with the shell 60 to be dispensed from the magazine 42 removed from same by the firearm, cycled through the litter 74, and loaded 61 into the firing chamber 62. As soon as the shell 60 to be dispensed is removed 75 from the magazine by the firearm, the spring bias from the magazine is removed from the shot shell, and the compressible portion of the shot shell de-compresses to form a shell 60' having the length 64' of a conventional shell, allowing proper processing of the shell to the firing chamber without jamming.

Upon firing of the shell, the compressible extension may be ejected with the load, in which the remaining fired shell casing 65 is ejected 66 from the firearm, and, in semi-automatic firearms, the next shell to be dispensed is removed from the magazine for loading, wherein again it expands to conventional shell length upon removal from the magazine.

Figure 13:
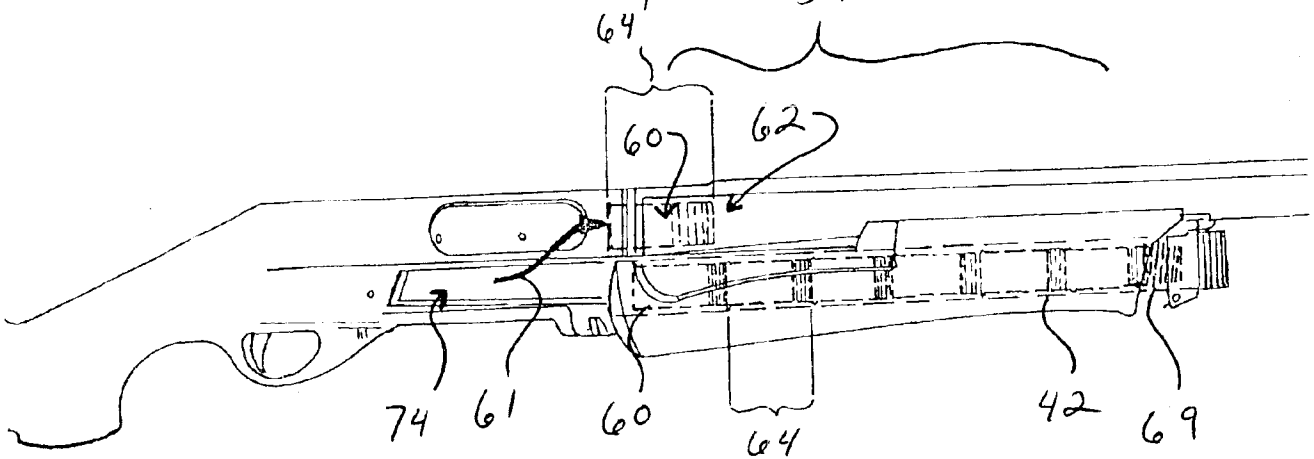
FIG. 13 is a side, partially cut-away view illustrating a firearm having a plurality of compressed short shells of the present invention therein, and a single un-compressed shot shell of the invention in the firing chamber.
Figure 14:
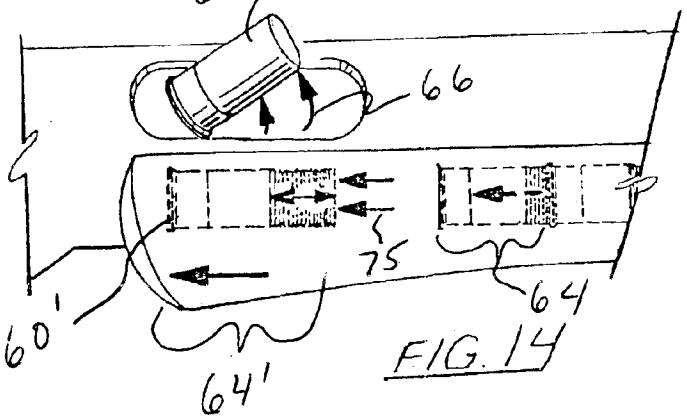
FIG. 14 is a side, partially cut-away view illustrating a fired shell casing of the present invention ejecting from the firearm, whilst simultaneously an compressed shot shell is removed from the magazine, and uncompresses to a full shell length, for proper manipulation and placement into the firing chamber of the fire arm.
Figure 14A:
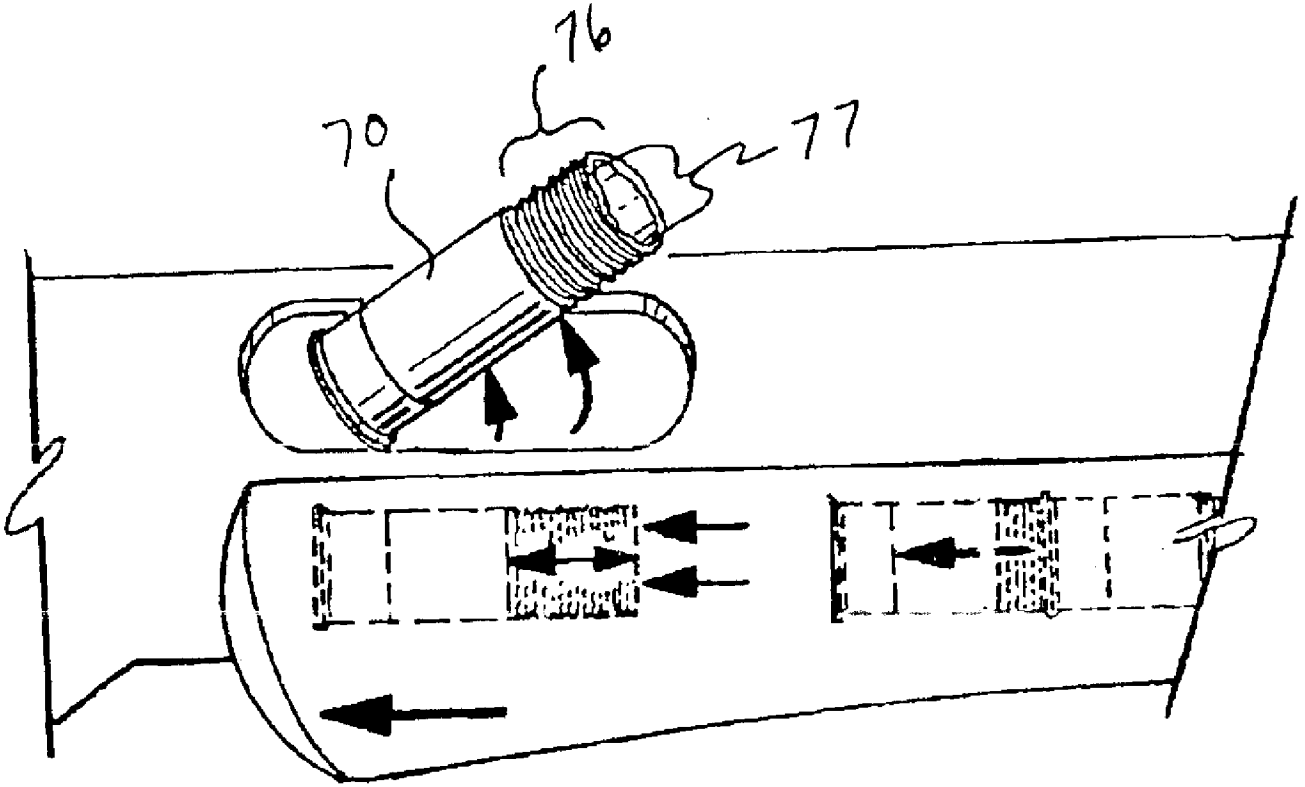
FIG. 14A is a side, partially cut-away view of the an alternative shot shell of that illustrated in FIG. 14, wherein the uncompressed outer portion remains with the shell as it is ejected, as opposed to being fired out of the barrel with the load.
Figure 15:
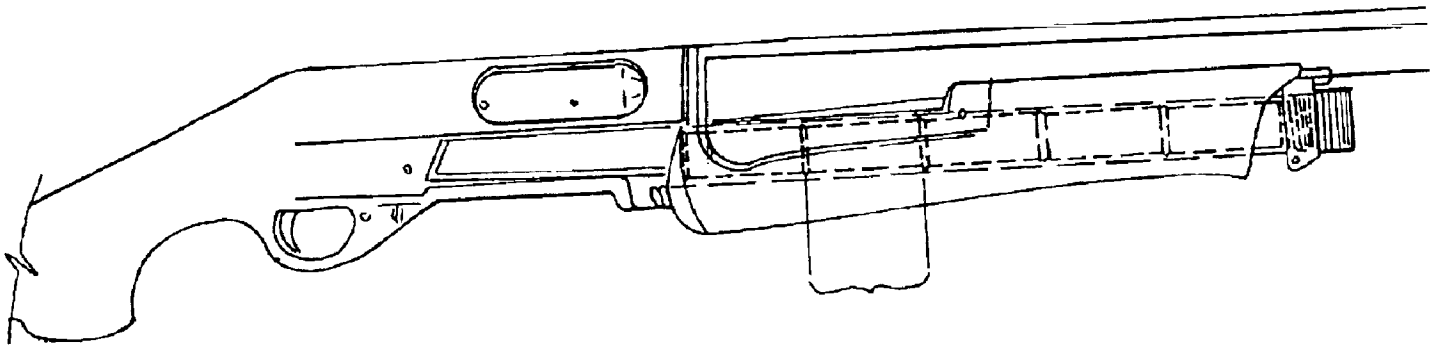
FIG. 15 is a side, partially cut-away view of a conventional firearm having conventional shot shells loaded therein, with a maximum illustrated load of five shells.
Figure 16:
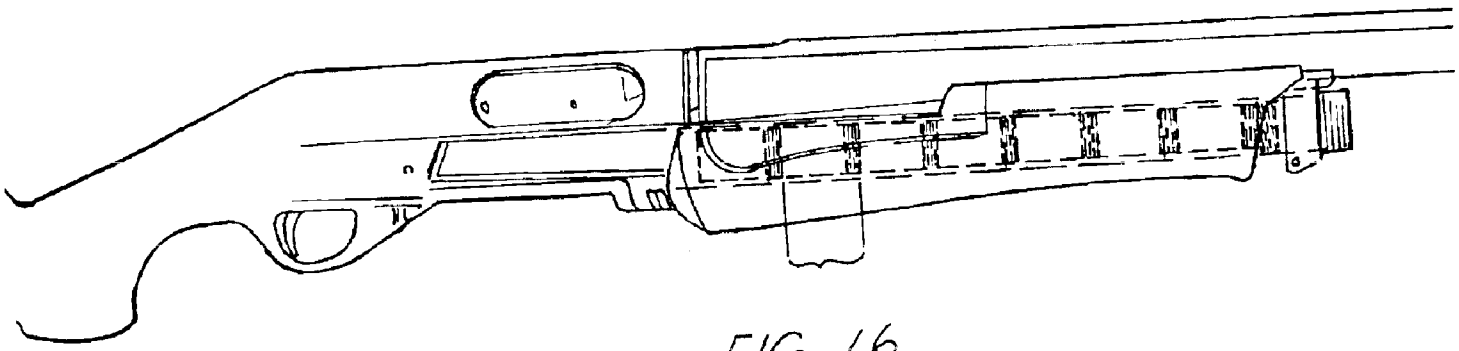
FIG. 16 is a side, partially cut-away view of a conventional firearm having exemplary shot shells of the present invention compressed in the magazine, providing an increased load of seven shells.

Referring to FIGS. 13 and 14A, in the compressible shot shell 70 with the integrated compressible portion of the present invention is loaded and fired as above, but the compressible portion remains a part of the shell casing with the load and contents of the shell passing through the inner diameter 77 of the compressible portion, and the shell 70 with integrated compressible portion is ejected from the firearm as a single piece for disposal or reloading.

While the above example illustrates use of the present system with a series of similar shells, it is noted that one could mix conventional shot shells with the compressible shells of the present invention and achieve like results with increased shell capacity in the magazine, although not as much as if only compressed shells were used.

RECITATION OF THE ELEMENTS

Figure 12:
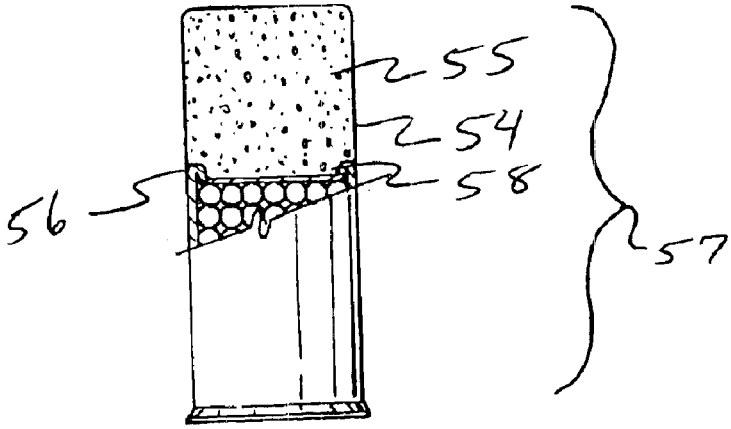
FIG. 12 is a side, partially cut-away view of the sixth embodiment of the invention, illustrating a short shot shell having emanating therefrom a compressible foam portion.

| Element | Description |
|---|---|
| 1,' | shell |
| 2,' | first, second ends |
| 3,' | tube |
| 4,' | shot |
| 5,' | wad |
| 6,' | powder |
| 7,' | primer |
| 8,' | cushion |
| 9,' | head |
| 10, 10' | length |
| 11,' | basewad |
| 12,' | crimp |
| 13,' | shot cover |
| 14,' | enclosure |
| 15 | first embodiment (FIG. 3) |
| 16 | helical spring |
| 17,' | first second ends |
| 18 | uncompressed length |
| 19 | engaged |
| 20 | second embodiment (FIG. 4) |
| 21 | accordian compressible plastic shot cover |
| 22 | folds |
| 23 | first second ends |
| 24 | engaged |
| 25 | third embodiment (FIGS. 5, 6) |
| 26 | compressible spiral crimp and twist extension of tube |
| 27,' | fold, I.D. |
| 28 | adhered |
| 29 | forced outward |
| 30 | fourth embodiment (FIGS. 7, 8) |
| 31 | bellows tube compressible extension of tube |
| 32 | fold |
| 33 | length |
| 34 | adhered |
| 35 | I.D. |
| 36 | forced outward |
| 37 | ejected |
| 38 | shell |
| 40 | inserted into |
| 41 | firearm |
| 42 | magazine |
| 45 | fifth embodiment (FIGS. 10, 11) |
| 46 | compressible extension of tube |
| 47 | foam core |
| 48 | ejected |
| 49,' | length |
| 50 | compresses |
| 51 | folds |
| 54 | sixth embodiment (FIG. 12) |
| 55 | compressible foam extension |
| 56 | adhered to |
| 57 | uncompressed length, compressed length |
| 58 | load end |
| 59 | shells |
| 60 | compressed shell |
| 61 | loaded |
| 62 | firing chamber |
| 64,' | length |
| 65 | fired shell casing |
| 66 | ejected |
| 69 | spring |
| 70 | alternative shell casing |
| 74 | litter |
| 75 | removal |

-continued

| Element | Description |
|---|---|
| 76 | collapsible portion |
| 77 | inner diameter |

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A shot shell having first and second ends and a length, comprising:

a compressible portion situated at said first end of said shot shell;

whereby, upon loading said shot shell into a magazine of a firearm, said compressible portion compresses so as to decrease the length of said shot shell, thereby increasing the magazine capacity of said firearm, thereby providing a compressed shot shell; and whereby, upon removing said compressed shot shell from the magazine of the firearm, said compressible portion un-compresses to increase the length of said shot shell so as to prevent jamming of the firearm.

2. The shot shell of claim 1, whereby said compressed shell un-compresses upon removal from the magazine to increase the length of said shot shell as it is being loaded into a firing chamber of the firearm.

3. The shot shell of claim 1, wherein said shot shell has a load end wherein a load is situated, and wherein said compressible portion is removably adhered to said load end of said shot shell.

4. The shot shell of claim 3, wherein said compressible portion is ejected from said firearm with said load when said shot shell is fired from said firearm.

5. The shot shell of claim 4, wherein said compressible portion comprises a spring.

6. The shot shell of claim 5, wherein said spring is crimped to said shell.

7. The shot shell of claim 5, wherein said shot shell further comprises a shot cover, and wherein spring is engaged to said shot cover.

8. The shot shell of claim 5, wherein said shot shell further comprises a wad, and wherein said spring is engaged to said wad.

9. The shot shell of claim 5, wherein said spring is a helical spring.

10. The shot shell of claim 5, wherein said spring is an air spring.

11. The shot shell of claim 5, wherein said spring is a foam spring.

12. The shot shell of claim 5, wherein said spring is formed of a polymer.

13. The shot shell of claim 5, wherein said spring if formed of a plurality of folds from a material having a memory bias so that it is compressible when longitudinal bias is applied thereto, but un-compresses to a predetermined length upon the cessation of longitudinal bias.

14. The shot shell of claim 1, wherein said shot shell has a load end wherein a load is situated, and wherein said compressible portion is emanates from said load end of said shot shell.

15. The shot shell of claim 14, wherein said compressible portion has an inner diameter through which passes said load upon firing of said shot shell.

16. The shot shell of claim 15, wherein said compressible portion comprises a spring.

17. The shot shell of claim 16, wherein said spring is formed of a polymer.

18. The shot shell of claim 17, wherein said spring if formed of a plurality of folds from a material having a memory bias so that it is compressible when longitudinal bias is applied thereto, but un-compresses to a predetermined length upon the cessation of longitudinal bias.

19. The shot shell of claim 16, wherein said spring is a helical spring.

20. The method of increasing the capacity of a firearm having a magazine, comprising the steps of:

a. providing a shot shell having a length and a first end having a compressible portion;

b. loading said shot shell in said magazine;

c. compressing said compressible portion of said shot shell so as to decrease the length of said shot shell, providing a compressed shell.

21. The method of claim 20, wherein after step "c." there is further provided the additional step "d." of repeating steps a.–c. until said magazine is full.

22. The method of claim 21, wherein after step "d." there is further provided the additional step "e." of removing said compressed shell from said magazine, uncompressing said compressed shell to form an un-compressed shell of greater length than said compressed shell, and loading said un-compressed shell into the firing chamber of said firearm, providing a loaded shell.

23. The method of claim 22, wherein after step "e." there is further provided the additional step "f." of firing said loaded shell so as to eject said compressed portion through the barrel of said firearm.

24. The method of claim 22, wherein the step "e." there is further provided the additional step "f." of firing said loaded shell such that the load of said shell passes through the inner diameter of said compressed portion, providing a fired shell, thereby maintaining said compressed portion with said fired shell.

25. The shot shell of claim 10, wherein said air spring comprises a compressible air pocket.

26. The shot shell of claim 11, wherein said foam spring comprises a compressible piece of foam.

* * * * *